US005558830A

United States Patent [19]

Powers, Jr. et al.

[11] Patent Number: 5,558,830

[45] Date of Patent: Sep. 24, 1996

[54] WAND PURGING FOR ELECTROSTATIC CHARGING SYSTEM IN FLASH SPINNING PROCESS

[75] Inventors: Ervin T. Powers, Jr., Midlothian, Va.; Edgar N. Rudisill, Hermitage, Tenn.

[73] Assignee: E. I. Du Pont de Nemours and Company, Wilmington, Del.

[21] Appl. No.: 348,684

[22] Filed: Dec. 2, 1994

[51] Int. Cl.[6] ..... D01D 5/11

[52] U.S. Cl. ..... 264/441; 134/37; 264/39; 264/205; 264/465

[58] Field of Search ..... 264/24, 39, 103, 264/169, 205, 211.14, 441, 465; 134/37

[56] References Cited

U.S. PATENT DOCUMENTS

| | | | |
|---|---|---|---|
| 3,227,784 | 1/1966 | Blades et al. | 264/53 |
| 3,319,309 | 5/1967 | Owens | 19/29 |
| 3,320,479 | 5/1967 | Owens | 361/230 |
| 3,387,326 | 6/1968 | Hollberg et al. | 425/72.2 |
| 3,535,588 | 10/1970 | Crook | 361/229 |
| 3,565,979 | 2/1971 | Palmer | 264/24 |
| 3,578,739 | 5/1971 | George | 425/72.2 |
| 3,689,608 | 9/1972 | Hollberg et al. | 264/24 |
| 3,851,023 | 11/1974 | Brethauer et al. | 264/24 |
| 3,860,369 | 1/1975 | Brethauer et al. | 425/3 |
| 4,554,207 | 11/1985 | Lee | 428/288 |

FOREIGN PATENT DOCUMENTS

| | | | |
|---|---|---|---|
| WO90/14172 | 11/1990 | WIPO | 264/39 |

*Primary Examiner*—Leo B. Tentoni

[57] ABSTRACT

This invention relates to a method and apparatus for sweeping dust and debris from the needles of a wand which is for applying an electrostatic charge to a plexifilamentary film-fibril web. The needles of the wand tend to acquire dust and debris from the polymer and by the present invention the dust and debris are efficiently swept away by a gaseous fluid flow over the needles preferably so that the fluid passes circumferentially over the needles through an annular passage.

3 Claims, 3 Drawing Sheets

WAND PURGING FOR ELECTROSTATIC CHARGING SYSTEM IN FLASH SPINNING PROCESS

FIELD OF THE INVENTION

The present invention relates to flash spinning of fiber forming polymers and in particular to the electrostatic charge applying system within a flash spinning apparatus.

BACKGROUND OF THE INVENTION

As noted in other patents and patent applications assigned to the assignee of the present invention, E. I. du Pont de Nemours and Company (DuPont), CFC solvents are presently used to manufacture flash-spun polyolefins such as Tyvek® spunbonded polyolefin. Tyvek® is a registered trademark of DuPont. However, CFC's are believed to have harmful environmental effects such as ozone depletion and are thus to be eliminated from conventional use. Plans are very much underway to continue making Tyvek® spunbonded olefin using a non-CFC solvent. However, the system using the new solvent tends to use higher charging currents and produces product at much lower throughputs as compared to the current system. Both the lower throughput and higher charging current tend to create more polymer dust during spinning. Thus, the electrostatically charged parts tend to become coated with dust and ultimately interferes with the efficient operation of the charging system, the uniformity of the charging, and the quality of the nonwoven sheet.

The electrostatic charging system basically comprises a DC voltage source, a wand or ion gun, and a conductive target plate connected to a suitable ground and spaced from the wand. A corona field is created between the wand and the target plate by the DC voltage source and the web is directed through the corona field to pick up charged particles that are migrating from the wand to the target plate. The wand basically comprises a plurality of needles, spaced along an arc, all of which are directed towards the target plate.

As the fiber is spun into the a continuous plexifilamentary film-fibril web, some of the polymer forms a fine dust that may float around the spin cell and collect on the components therein. Some of the dust also acquires a charge and therefore becomes attracted to and collects on both the needles and the target plate. Accumulation of polymer dust on the elements of the electrostatic charging system increases the resistance (since the polymer is not very conductive) resulting in higher energy requirements to maintain a sufficient charge on the web. As such, dust tends to foul the electrostatic charging system increasing energy requirements to continue to provide a suitable charge on the web. Eventually, electrostatic fouling will cause energy requirements to exceed predetermined current levels causing the pack to be shut down for replacement.

Spin packs are commonly shutdown and replaced for a variety of reasons. DuPont closely monitors pack life and pack mortality (why the pack had to be removed from service) because of its effect on the sheet quality and the profitability of the business. As noted above, high energy requirements and electrostatic fouling are common causes of pack failure. Based on tests using pentane hydrocarbon as a solvent, it is anticipated that more dust will be generated in the spin cell and that higher charging currents will be required to obtain as suitable charge on the web. Thus, it will be very likely that pack life will become almost entirely dependent on the operational life of the electrostatic system. As discussed in other patents and applications, pack life for spinpacks in the manufacture of Tyvek® spunbonded olefin will have a substantial effect on the profitability of the business.

Accordingly, it is an object of the present invention to provide a system which avoids the drawbacks as described above.

It is a more particular object of the present invention to provide a system which reduces the tendency of polymer or other debris from collecting on the wand or ion gun needles that will interfere with the operation of the charging system.

SUMMARY OF THE INVENTION

The above and other objects of the present invention are accomplished by the provision of a cleaning system which provides a gaseous flow over the needles of the wand to direct dust and debris in the spin cell from collecting on the needles of the wand.

BRIEF DESCRIPTION OF THE DRAWINGS

The invention may be better understood by reference to drawings of a preferred embodiment thereof. Accordingly, drawings of the preferred embodiment have been included herewith wherein.

DETAILED DESCRIPTION OF THE PREFERRED EMBODIMENT

Figure 1:
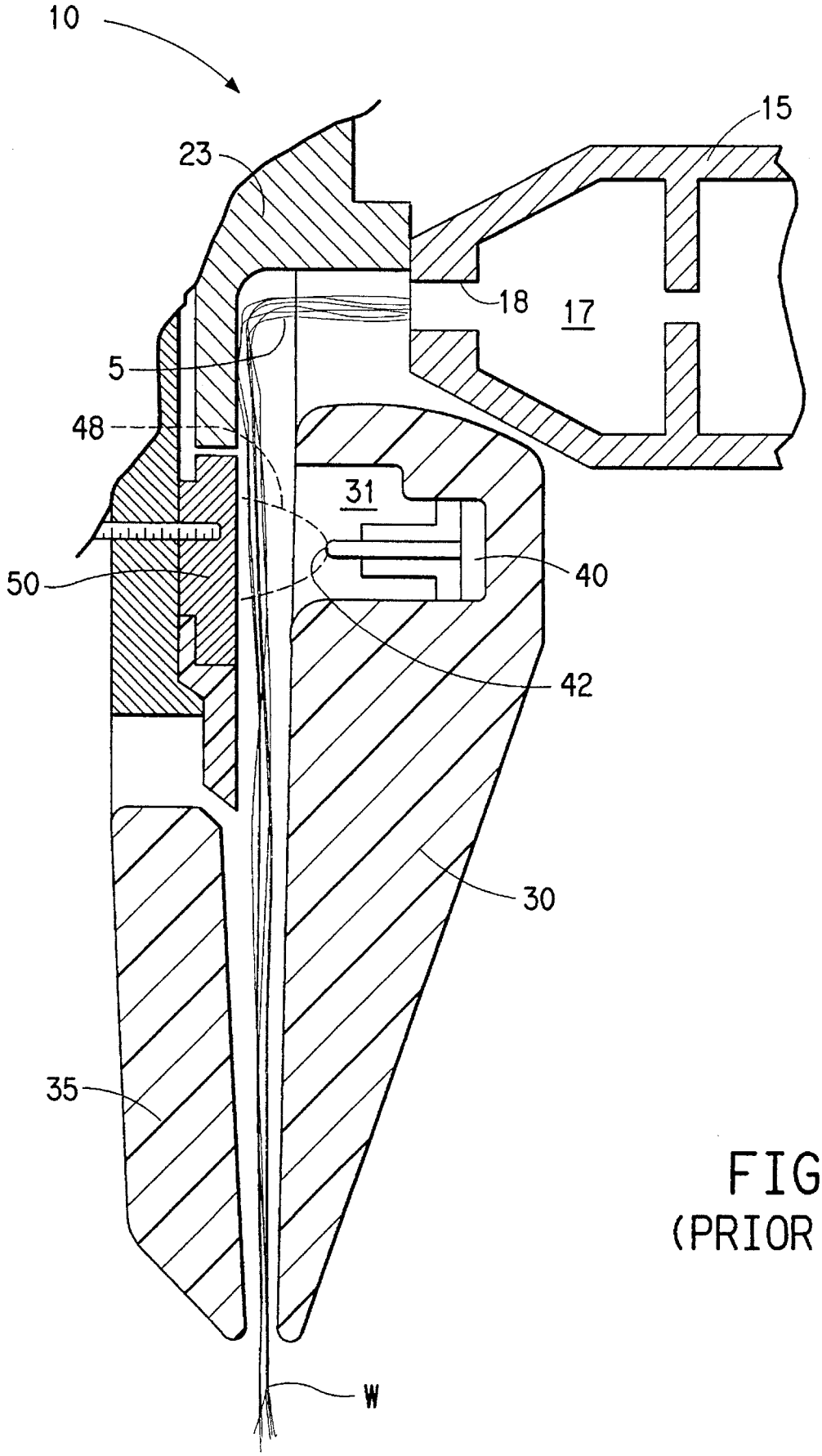
FIG. 1 (PRIOR ART)
FIG. 1 is a fragmentary cross sectional view of a conventional spinpack particularly illustrating the conventional form of the wand.

Turning now to the drawings, the invention will be described in relation to the wand as is currently configured and presently in use. The current configuration is shown in FIG. 1. The overall system is described in detail in other patents such as Blades et al (U.S. Pat. No. 3,227,784) and Brethauer et al (U.S. Pat. No. 3,851,023) which are incorporated herein by reference. Briefly, a spinpack generally indicated by the number 10, receives a polymer solution (polymer and solvent dissolved together) through a conduit 15 at elevated temperature and pressure. The polymer passes into a letdown chamber 17 near the spin orifice 18 to allow the spin mixture to drop to a slightly lower temperature prior to passing through the spin orifice 18. Upon passing through the spin orifice 18, the polymer solution enters the spin cell which has a much lower pressure and temperature.

As the polymer solution enters the spin cell environment, the solvent flashes and the polymer forms a plexifilamentary film-fibril strand S moving at very high speed. The strand S is directed to a baffle 23 where it is flattened and turned down toward a conveyor belt (not shown). The baffle also causes the flattened strand (now generally called a web W) to oscillate back and forth to lay it out across the conveyor belt (not shown) and form a batt suitable for pressing into a nonwoven sheet.

The path of the oscillating web W is between two spaced apart shields 30 and 35. A first shield 30 includes a recess 31 along an arc at its upper portion thereof. A wand 40 is mounted therein which includes a plurality of needles 42. Across the path of the web W from the wand 40 is a conductive target plate 50. The needles 42 are arranged to extend toward the target plate 50 such that the distal ends of the needles 42 do not quite project out from the recess 31.

In operation, the wand 40 and the target plate 50 are provided with a suitable DC charge and electric ground so that charged particles, i.e. electrons, ions or molecules, are formed on the tips of the needles 42 and move toward the target plate 50. The area of concentration of charged particles moving to the target plate is the corona field 48 which is generally indicated by the dashed lines extending from the needle 42 to the target plate 50. As the charged particles move toward the target plate 50 some of the particles are collected onto the web W and carried therewith to the conveyor belt. The resulting charge on the web W helps to maintain the plexifilaments in an open, spaced apart arrangement and also helps pin the web W down to the conveyor belt.

Figure 2:
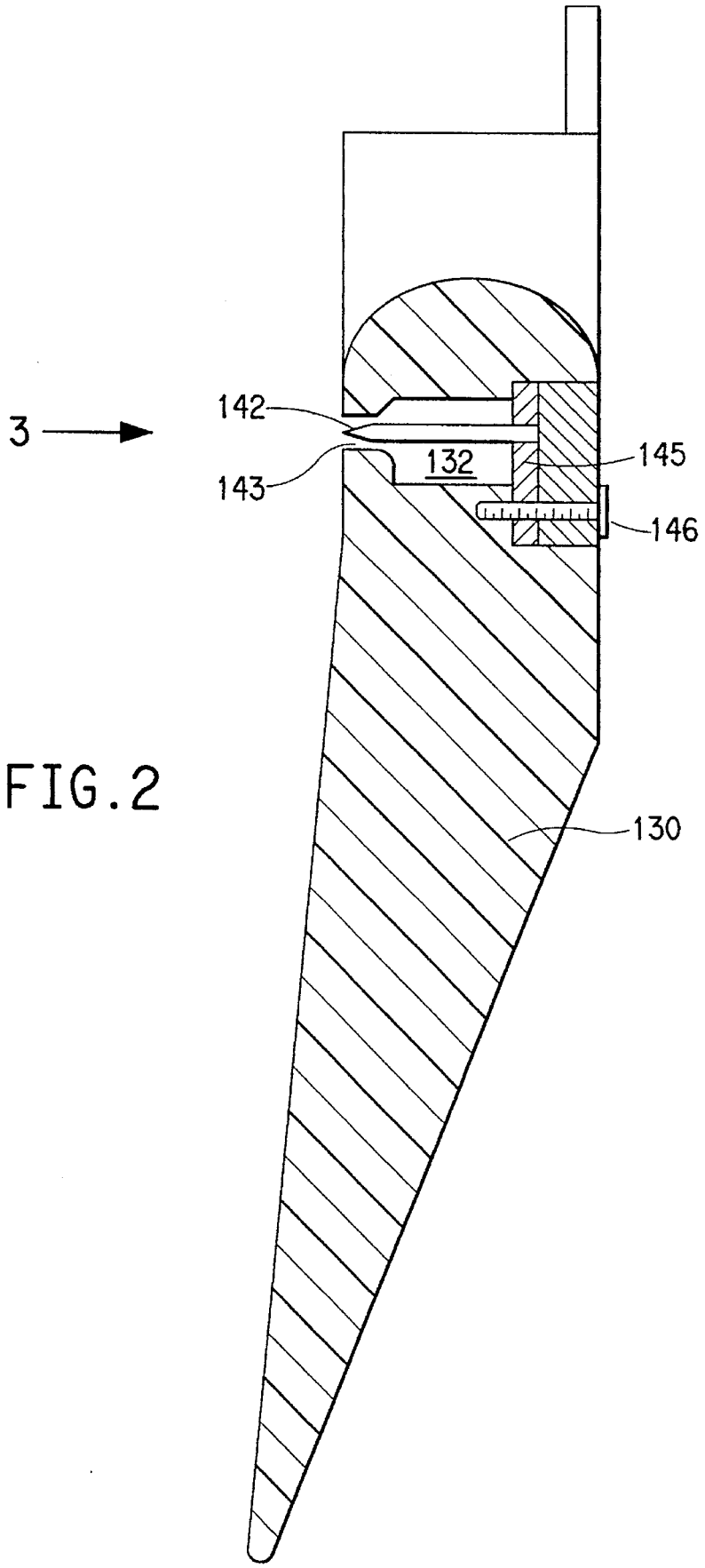
FIG. 2 is a fragmentary cross sectional view of the preferred embodiment of the diffuser wherein the wand is provided with the cleaning arrangement.
Figure 3:
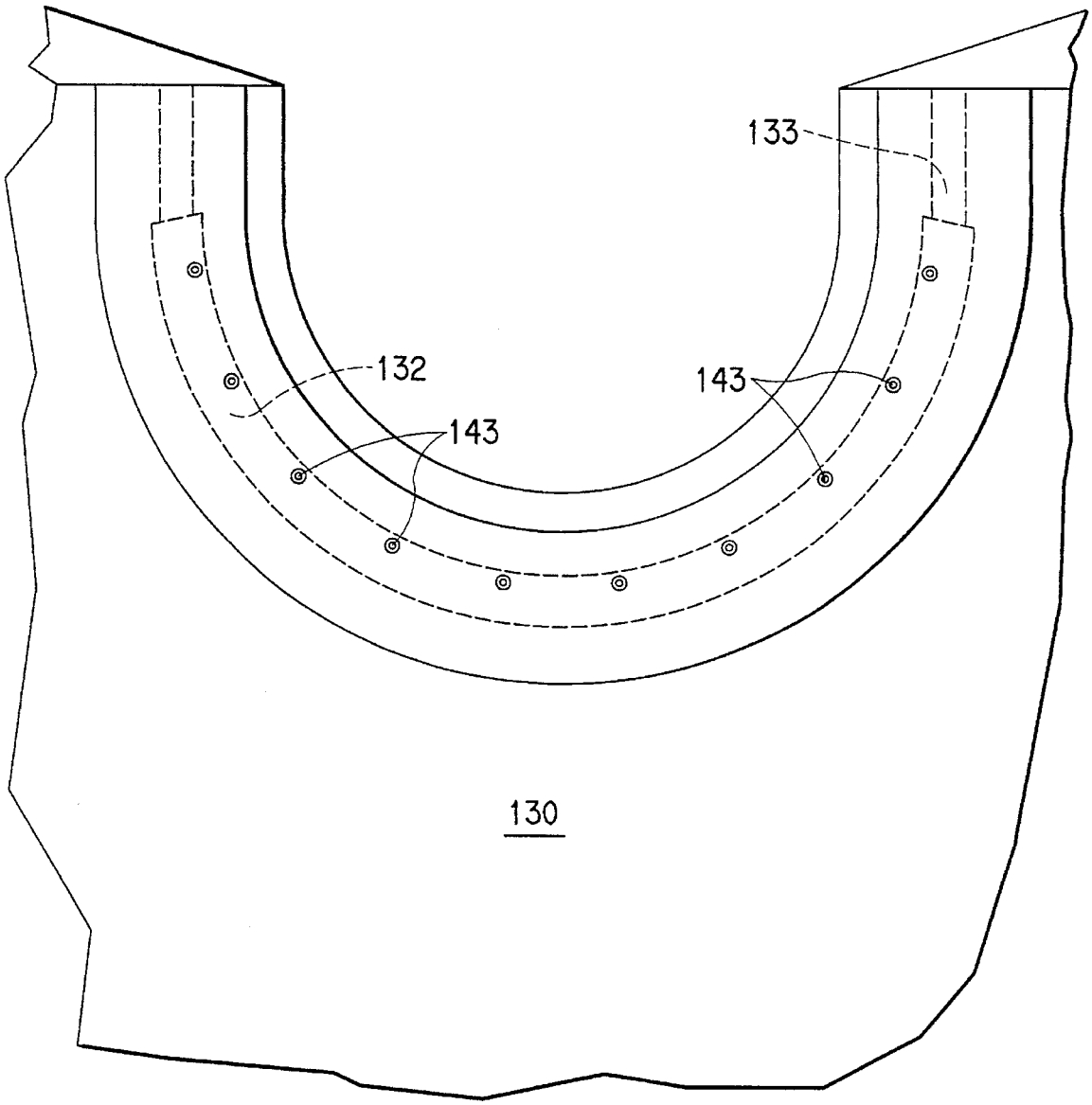
FIG. 3 is a fragmentary front view of the wand and diffuser shown in FIG. 2 as indicated by the arrow 3 in FIG. 2.

As described above, dust is formed in the spin cell by polymer debris that did not form into the continuous strand S. In the present arrangement, the needles 42 are open to any dust which gets between the shields 30 and 35. In FIGS. 2 and 3, there is illustrated a preferred embodiment of the present invention which provides greater resistance to having dust and debris collecting on the needles. In FIGS. 2 and 3, equipment that is essentially the same as in FIG. 1 has been identified with a similar number except that it is now a three digit number with the first digit being 1. For example, the first shield is number 30 in FIG. 1 and 130 in FIG. 2. That being understood, the description of the invention will continue.

In the present invention, the needles 142 are attached to a generally flat, arc shaped mounting bracket 145 such that the needles are generally normal to the plane of the flat bracket 145. The front shield 130 has a recess 132, but it faces away from the path of the web W rather than facing toward the path. The front shield 130 also includes a plurality of little holes 143 arranged to receive the distal end of each needle 142. It is preferred that the distal ends of the needles 142 protrude about 0.031±0.006 inches from the face of the front shield 130 into the path of the fiber. It is more preferable to have the distal ends of the needles protruding 0.031±0.003 inches from the face of the front shield 130. The holes 143 are also sized to have a diameter slightly larger than the diameter of each needle 142. In the preferred embodiment, the needle is 0.058 inches in diameter (not including the portion that tapers down at the end) and the hole is 0.094 inches in diameter.

The mounting bracket 145 is attached by suitable means such as bolts 146 to close the recess 132 and thereby essentially reform the recess into a plenum chamber within the shield 130. The resulting plenum chamber 132 is connected by a conduit 133 (best seen in FIG. 3) and other suitable means, such as a hose, etc. (not shown), to a suitable source of vaporized solvent. It should be noted that any gaseous fluid that is compatible with the solvent and the spin cell environment may be provided to the plenum chamber 132 to use in the inventive arrangement. As the gaseous fluid, preferably vaporized solvent, is provided into the conduit 133, it fills the plenum chamber 132 and passes out through the holes 143.

As may have been alluded to above, the holes 143 form annular passages around the needles 142 that substantially circumscribe each needle. As such, a stream of vaporized solvent moves along the length of each of the needles 142 to sweep any dust or polymer therefrom and to resist the momentum of any dust from entering the holes 143. The flow of vaporized fluid is dedicated to the task of sweeping away dust and debris and need not be very substantial as it is desirable not to change the aerodynamics of the flow of gases between the shields that accompany the web W. Typically, the flow of vaporized solvent around each needle is 0.75 scfm for a 10 needle array. This can be compared to a flow of about 260 scfm between the shields from all sources. Also, since the flow of vaporized solvent through the holes 143 is intended to be continuous, it is expected to be suitable to deflect and disperse dust or debris before it can contact the needles 142 or become firmly attached thereto. Preferably, the dust and debris is deflected into the more substantial vapor flow accompanying the web W to be carried along therewith and carried away on the forming sheet on the conveyor belt. As such the dust and debris would then be away from the electrostatic charging system and may be captured by suitable filters or other atmospheric control equipment in the spin cell, e.g. netting arrayed in the upper portion of the spin cell.

In a second preferred embodiment which is not shown, a second arc of needles is provided which is generally concentric with the first. The second row or arc of needles would include a second plenum chamber but be essentially the same as the first as shown in FIGS. 2 and 3. By the second preferred embodiment, the web W passes through a second corona field and will have a satisfactory charge applied thereto. Clearly other mechanical variations of this invention can be foreseen.

The foregoing description is provided solely to explain the details of the invention and the preferred embodiment. The scope or range of equivalents shall not be diminished by the description. For a clear definition of the scope of protection provided by the patent laws, please refer to the claims that follow.

We claim:

1. A process for flash spinning fiber forming polymer into a plexifilamentary film-fibril web and laying down the web to form a nonwoven batt material therefrom, the process comprising the steps of:

flash spinning polymer into a plexifilamentary web;

applying a charge to the web by passing the web between at least one electrically charged needle and a conductive target surface;

laying the web onto a surface to form the web into a batt that is suitable for being pressed into a sheet; and impacting each needle with a stream of gaseous fluid to sweep away polymer dust and debris generated by the spinning process.

2. The process according to claim 1 wherein the step of impacting the needles with a stream of gaseous fluid further comprises providing a stream of vaporized solvent wherein the solvent is the same solvent used in the flash spinning step.

3. The process according to claim 1 wherein the step of impacting the needles with a stream of gaseous fluid further comprises providing an annular stream substantially circumscribing each needle and directed toward the distal end of each needle in the direction of the conductive target surface.

* * * * *